US011391068B2

(12) United States Patent
Harris

(10) Patent No.: US 11,391,068 B2
(45) Date of Patent: Jul. 19, 2022

(54) DOOR SECURITY ASSEMBLY

(71) Applicant: Jeffrey Harris, Mitchell, SD (US)

(72) Inventor: Jeffrey Harris, Mitchell, SD (US)

( * ) Notice: Subject to any disclaimer, the term of this patent is extended or adjusted under 35 U.S.C. 154(b) by 183 days.

(21) Appl. No.: 16/885,560

(22) Filed: May 28, 2020

(65) Prior Publication Data

US 2021/0372166 A1 Dec. 2, 2021

(51) Int. Cl.

| | |
|---|---|
| ***E05B 13/00*** | (2006.01) |
| ***E05B 65/10*** | (2006.01) |
| ***E05C 1/10*** | (2006.01) |
| ***E05C 19/00*** | (2006.01) |

(52) U.S. Cl.

CPC ..... *E05B 65/1093* (2013.01); *E05B 13/002* (2013.01); *E05C 1/10* (2013.01); *E05C 19/003* (2013.01); *E05Y 2900/132* (2013.01)

(58) Field of Classification Search

CPC ..... E05B 65/1093; E05B 13/002; E05C 1/10; E05C 19/003; E05Y 2900/13

See application file for complete search history.

(56) References Cited

U.S. PATENT DOCUMENTS

| | | | | |
|---|---|---|---|---|
| 1,593,852 | A | 7/1926 | Shaw | |
| 4,322,104 | A * | 3/1982 | Matthews, Jr. | E05B 65/1066 292/288 |
| 4,429,909 | A * | 2/1984 | Lindquist | E05B 65/1066 292/92 |
| 5,340,172 | A | 8/1994 | Sweet | |
| 5,490,696 | A * | 2/1996 | Hutson | E05B 65/1073 292/139 |
| 5,605,364 | A | 2/1997 | Shelledy | |
| 5,622,397 | A | 4/1997 | Rice | |
| 5,826,923 | A | 10/1998 | Bethurem | |
| 6,530,247 | B2 * | 3/2003 | Moores | E05C 19/003 292/258 |
| 6,560,925 | B1 * | 5/2003 | Rice | E05B 13/002 292/259 R |
| 7,634,927 | B1 | 12/2009 | Tien | |
| 8,414,036 | B2 * | 4/2013 | Baillia-Prel | E05B 65/1066 292/92 |
| 10,184,278 | B2 | 1/2019 | Lowe | |
| 10,407,954 | B2 | 9/2019 | Lowe | |
| 2010/0117376 | A1 | 5/2010 | Shen | |

* cited by examiner

*Primary Examiner* — Kristina R Fulton
*Assistant Examiner* — Thomas L Neubauer

(57) ABSTRACT

A door security assembly for blockading a door in a lock-down situation includes a blockade device. An element of the blockade device insertable into a gap defined by a door and a crash bar that is engaged to the door. Each of a pair of fasteners engaged to the blockade device is selectively engageable the crash bar, so that the blockade device is reversibly engaged to the crash bar with the element positioned in the gap. The blockade device prevents actuation of the crash bar so that the door cannot be opened. The fasteners are positioned so that two hands are required to simultaneously disengage the fasteners from the crash bar to enable disengagement of the blockade device from the crash bar.

11 Claims, 6 Drawing Sheets

DOOR SECURITY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to security assemblies and more particularly pertains to a new security assembly for blockading a door in a lockdown situation.

(2) Description of Related Art Including Information Disclosed Under 37 CFR 1.97 and 1.98

The prior art relates to security assemblies. Prior art security assemblies for doors many comprise devices that attach to opening mechanisms of doors. Prior art security assemblies also may comprise bars that extend past the door jambs of a doorway

BRIEF SUMMARY OF THE INVENTION

An embodiment of the disclosure meets the needs presented above by generally comprising a blockade device. An element of the blockade device is configured to be insertable into a gap defined by a door and a crash bar that is engaged to the door. Each of a pair of fasteners engaged to the blockade device is configured to selectively engage the crash bar, so that the blockade device is reversibly engaged to the crash bar with the element positioned in the gap. The blockade device is configured to prevent actuation of the crash bar so that the door cannot be opened. The fasteners are positioned so that two hands are required to simultaneously disengage the fasteners from the crash bar to enable disengagement of the blockade device from the crash bar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
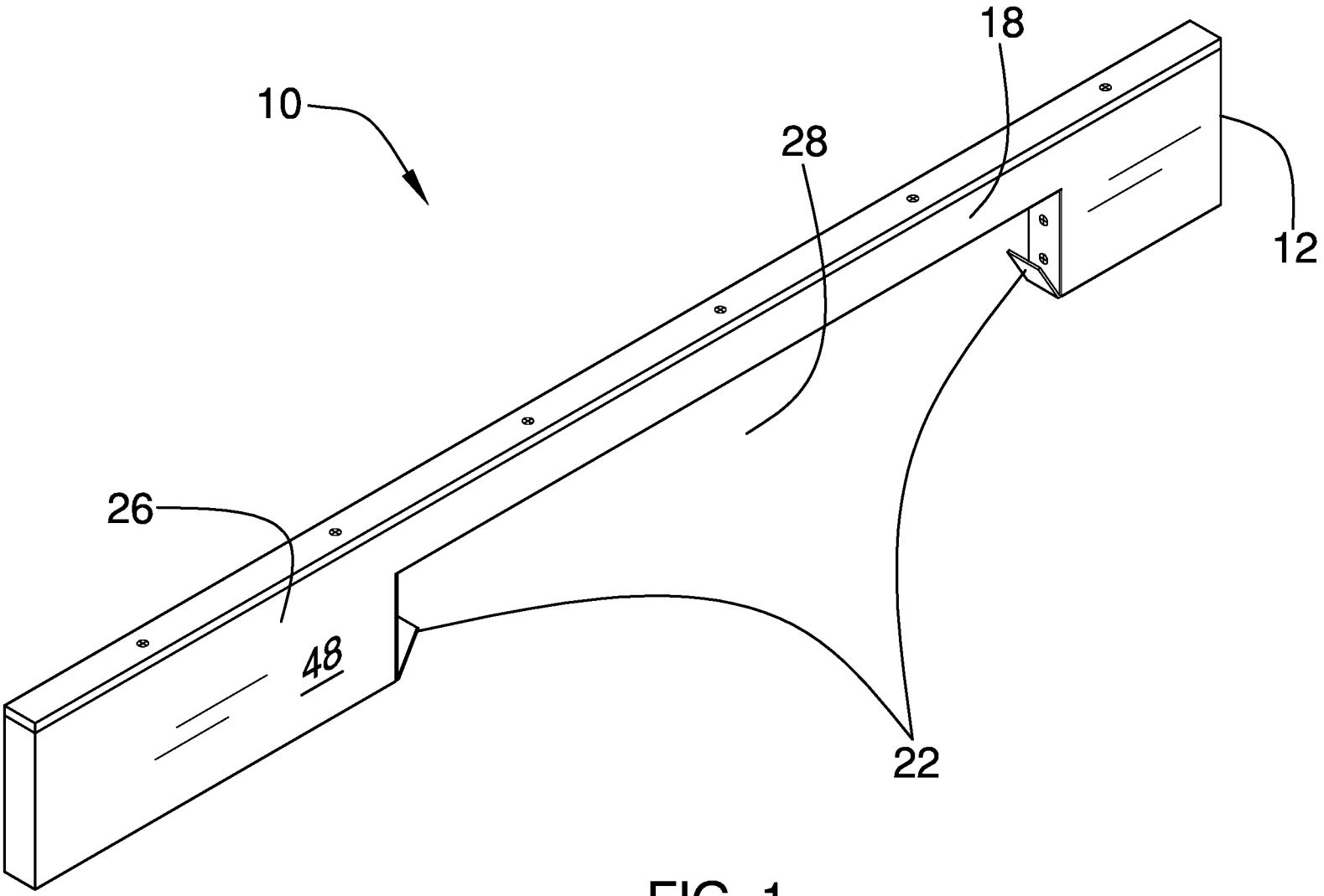
FIG. 1 is an isometric perspective view of a door security assembly according to an embodiment of the disclosure.

With reference now to the drawings, and in particular to FIGS. 1 through 6 thereof, a new security assembly embodying the principles and concepts of an embodiment of the disclosure and generally designated by the reference numeral 10 will be described.

As best illustrated in FIGS. 1 through 6, the door security assembly 10 generally comprises a blockade device 12 for a door 14 having a crash bar 16 engaged thereto. An element 18 of the blockade device 12 is configured to be insertable into a gap 20 defined by the door 14 and the crash bar 16. The crash bar 16, also known as a panic bar, panic device, and a push bar, is a form of lever tumbler lock that allows unlocking of the door 14 in certain emergency situations, such as during a fire. The crash bar 16 is fixed horizontally to an interior face 52 of an outwardly opening door 14. When the crash bar 16 is depressed, it activates a mechanism that unlatches the door 14, allowing occupants of a room or a building to quickly leave.

Each of a pair of fasteners 22, which is engaged to the blockade device 12, is configured to selectively engage the crash bar 16. The blockade device 12 thus is reversibly engaged to the crash bar 16 with the element 18 positioned in the gap 20. The blockade device 12 is configured to prevent actuation of the crash bar 16 so that the door 14 cannot be opened. The present invention is anticipated to be useful in alternative emergency situations where blockade of the door 14 will protect the occupants of the room or the building, such as an active shooter situation in a school, commercial building, and the like.

The fasteners 22 are positioned so that two hands are required to simultaneously disengage the fasteners 22 from the crash bar 16 to enable disengagement of the blockade device 12 from the crash bar 16. Therefore, even if a window 24 of the door 14 is broken, an active shooter exterior to the room or the building would have to reach through the window 24 with both arms and simultaneously manipulate both fasteners 22 to disengage the blockade device 12—a difficult maneuver deterring opening of the door 14.

Figure 4:
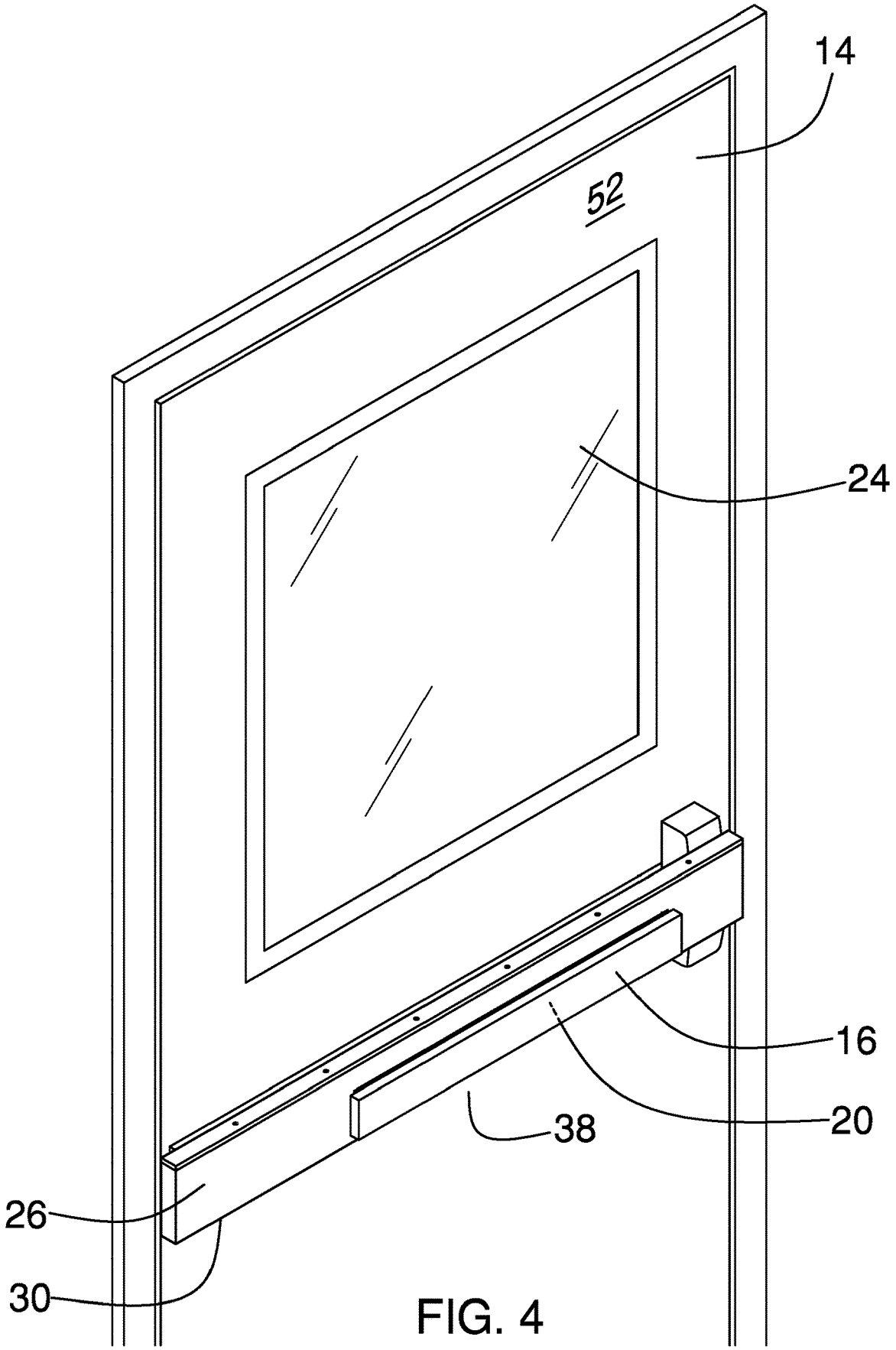
FIG. 4 is an in-use view of an embodiment of the disclosure.

The blockade device 12 may comprise a plate 26, which has a cutout 28 extending thereinto from a lower edge 30 thereof. The cutout 28 is configured for insertion of the crash bar 16. Concurrently, the plate 26 is inserted into the gap 20. The plate 26 may be sized so that the plate 26 extends past at least one door jamb of a doorway in which the door 14 is positioned, as shown in FIG. 4. The plate 26 is configured to engage the at least one door jamb to resist opening of the door 14.

Figure 2:
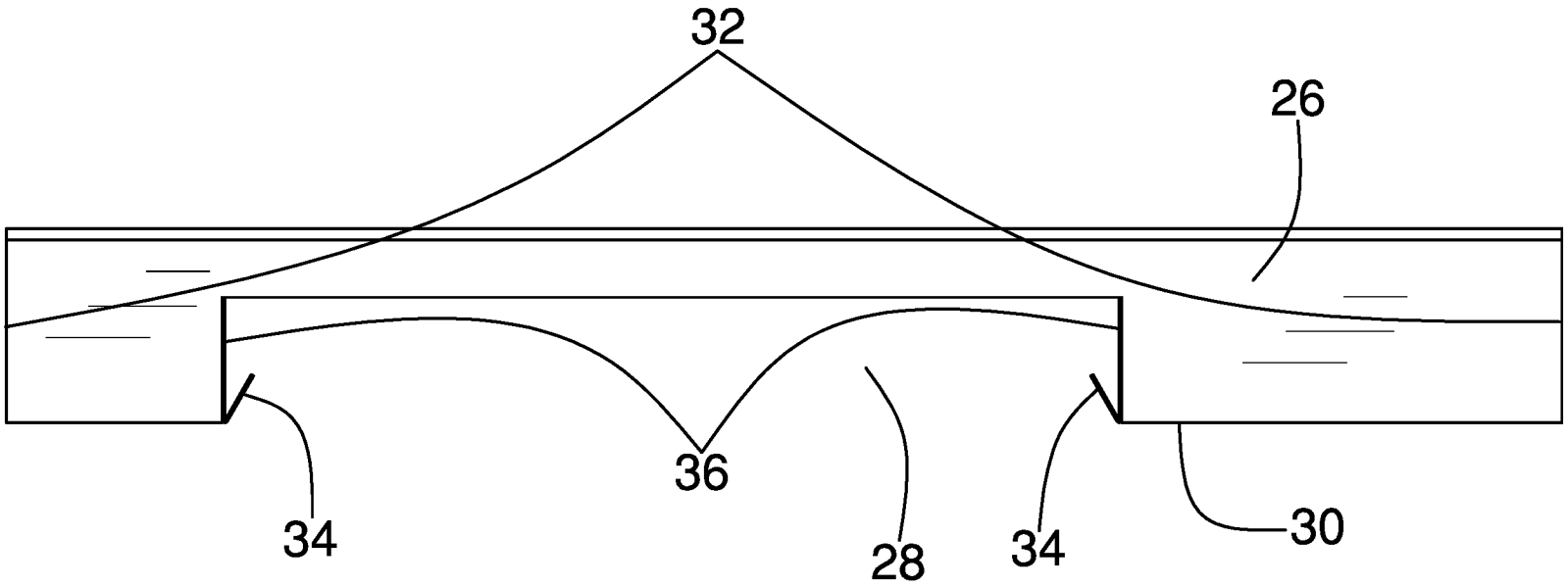
FIG. 2 is a rear view of an embodiment of the disclosure.
Figure 3:
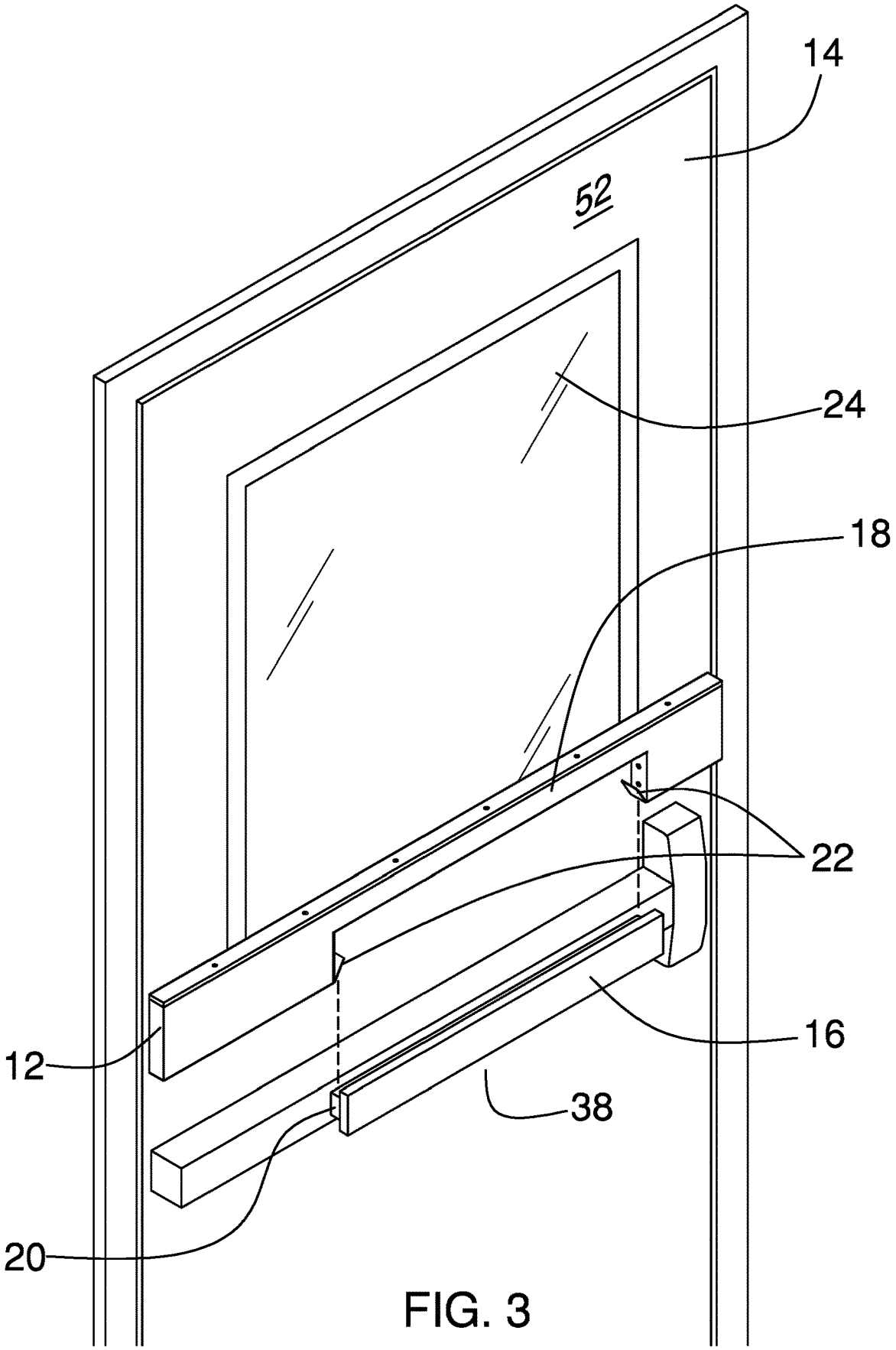
FIG. 3 is an in-use view of an embodiment of the disclosure.

The cutout 28 may be biased toward one of opposed ends 32 of the plate 26, as shown in FIG. 2. The present invention also anticipates the blockade device 12 comprising other blocking means, such as, but not limited to, housings that are positionable over and engageable to the crash bar 16, selectively sizeable rings positionable around the crash bar 16, and the like.

In one embodiment, as shown in FIG. 2, the fastener 22 comprises a clip 34, which is hingedly engaged to and which extends transversely from the plate 26 proximate to the lower edge 30 of the plate 26 and a respective opposed side 36 of the cutout 28. The clip 34 is resilient so that the clip 34 is configured to hinge toward the respective opposed side 36 of the cutout 28 as the plate 26 is positioned over the crash bar 16. The clip 34 is positioned to rebound when the crash bar 16 is fully inserted into the cutout 28. The clip 34 engages a lower face 38 of the crash bar 16 to fixedly engage the plate 26 to the crash bar 16 within the gap 20. The plate 26 is configured to prevent actuation of the crash bar 16 so that the door 14 cannot be opened.

Figure 5:
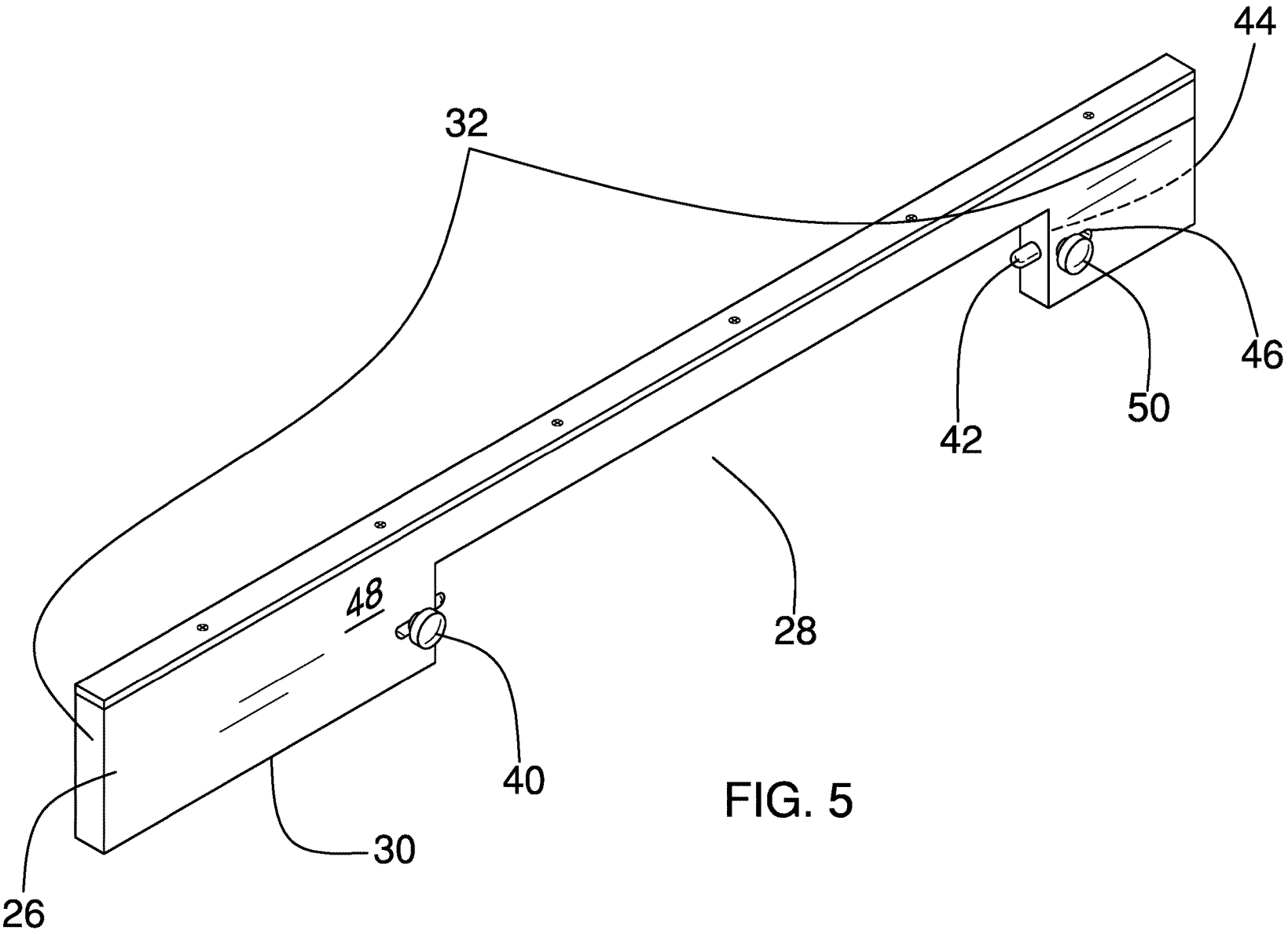
FIG. 5 is an isometric perspective view of an alternative embodiment of the disclosure.
Figure 6:
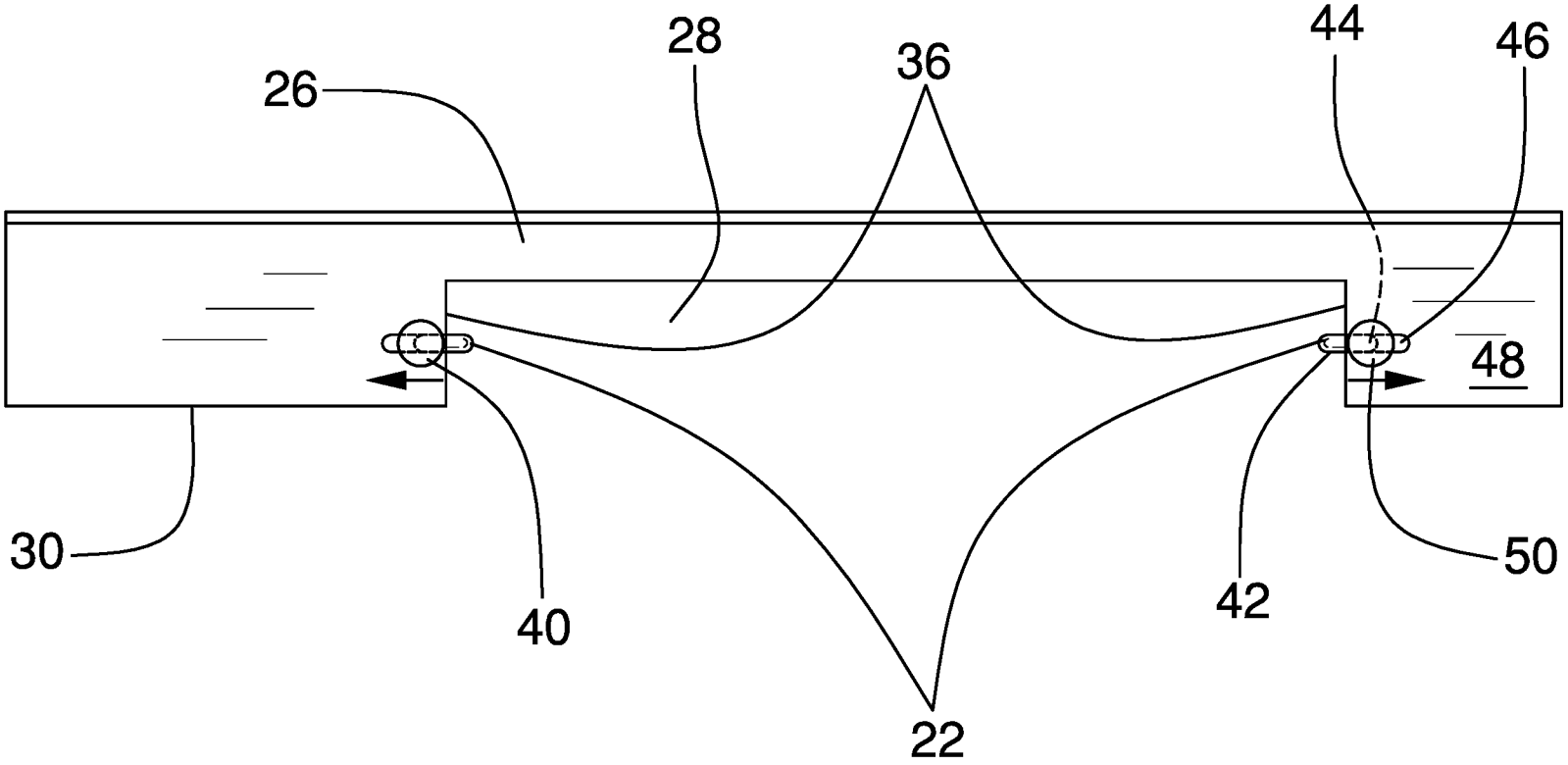
FIG. 6 is a front view of an alternative embodiment of the disclosure.

In another embodiment, as shown in FIG. 6, the fastener 22 comprises a slide lock 40. The slide lock 40 comprises a pin 42, which is selectively extensible into the cutout 28 from a channel 44. The channel 44 extends into the plate 26 from the respective opposed side 36 of the cutout 2. The plate 26 has a slot 46 positioned in a front face 48 thereof. The slot 46 extends to the channel 44. The pin 42 is spring loaded so that the pin 42 is biased to an extended configuration, as shown in FIG. 5.

A knob 50 extends from the front face 48 and through the slot 46. The knob 50 is engaged to the pin 42. The knob 50 is configured to be grasped in digits of a hand of a user, positioning the user to selectively slide the knob 50 within the slot 46 away from the respective opposed side 36 of the cutout 28 to retract the pin 42 into the channel 44. With the pins 42 retracted, the crash bar 16 can be inserted into the cutout 28. Upon release of the knob 50, the pin 42 extends from the channel 44 to engage the lower face 38 of the crash bar 16 to fixedly engage the plate 26 to the crash bar 16 within the gap 20. The plate 26 is configured to prevent actuation of the crash bar 16 so that the door 14 cannot be opened.

The present invention also anticipates the fastener 22 comprising other fastening means, such as, but not limited to, clasps, latches, quick connects, and the like.

In use, the plate 26 is positioned above the crash bar 16 and then lowered so that the crash bar 16 is inserted into the cutout 28 and the plate 26 is inserted into the gap 20 between the crash bar 16 and the door 14. As the plate 26 is lowered onto the crash bar 16, the crash bar 16 deflects the clips 34 to the side. When the plate 26 has been fully lowered, the clips 34 are free to rebound and to engage the lower face 38 of the crash bar 16. The clips 34 are positioned so that two hands are required to simultaneously disengage the clips 34 from the crash bar 16 to enable disengagement of the plate 26 from the crash bar 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A door security assembly comprising:

a blockade device having an element configured to be insertable into a gap defined by a door and a crash bar engaged thereto, wherein the blockade device comprises a plate having a cutout extending into a lower edge thereof, wherein the cutout is configured for insertion of the crash bar such that the plate is inserted into the gap; and a pair of fasteners engaged to the blockade device, each fastener being configured for selectively engaging the crash bar such the blockade device is reversibly engaged to the crash bar with the element positioned in the gap, wherein the blockade device is configured for preventing actuation of the crash bar such that the door cannot be opened, wherein each fastener comprises a slide lock, the slide lock comprising:

a pin selectively extensible into the cutout from a channel, the channel extending into the plate from a respective opposed side of the cutout, the plate having a slot positioned in a front face thereof and extending to the channel; and a knob extending from the front face and through the slot, the knob being engaged to the pin, wherein the knob is configured for grasping in digits of a hand of a user, positioning the user for selectively sliding the knob within the slot away from the respective opposed side of the cutout for retracting the pin into the channel, such that the crash bar is positionable in the cutout, such that the pin extends from the channel into the cutout upon release of the knob such that the pin engages the lower face of the crash bar for fixedly engaging the plate to the crash bar within the gap, wherein the plate is configured for preventing actuation of the crash bar such that the door cannot be opened.

2. The door security assembly of claim 1, wherein the plate is sized such that the plate extends past at least one door jamb of a doorway in which the door is positioned, wherein the plate is configured for engaging the at least one door jamb for resisting opening of the door.

3. The door security assembly of claim 1, wherein the cutout is biased toward one of opposed ends of the plate.

4. The door security assembly of claim 1, wherein the fastener comprises a clip hingedly engaged to and extending transversely from the plate proximate to the lower edge of the plate and a respective opposed side of the cutout, the clip being resilient wherein the clip is configured for hinging toward the respective opposed side of the cutout as the plate is positioned over the crash bar, such that the clip is positioned for rebounding when the crash bar is fully inserted into the cutout, such that the clip engages a lower face of the crash bar for fixedly engaging the plate to the crash bar within the gap, wherein the plate is configured for preventing actuation of the crash bar such that the door cannot be opened.

5. The door security assembly of claim 1, wherein the pin is spring loaded such that the pin is biased to an extended configuration.

6. A door and door security assembly combination comprising:

a door and a crash bar engaged thereto such that the door and the crash bar define a gap;

a blockade device having an element positioned for selectively inserting into the gap wherein the blockade device comprises a plate having a cutout extending into a lower edge thereof such that the cutout is positioned for insertion of the crash bar such that the plate is inserted into the gap; and a pair of fasteners engaged to the blockade device, each fastener being configured for selectively engaging the crash bar such the blockade device is reversibly engaged to the crash bar with the element positioned in the gap, such that the blockade device prevents actuation of the crash bar such that the door cannot be opened, wherein each fastener comprises a slide lock, the slide lock comprising:

a pin selectively extensible into the cutout from a channel, the channel extending into the plate from a respective opposed side of the cutout, the plate having a slot positioned in a front face thereof and extending to the channel; and a knob extending from the front face and through the slot, the knob being engaged to the pin, wherein the knob is configured for grasping in digits of a hand of a user, positioning the user for selectively sliding the knob within the slot away from the respective opposed side of the cutout for retracting the pin into the channel, such that the crash bar is positionable in the cutout, such that the pin extends from the channel into the cutout upon release of the knob, such that the pin engages the lower face of the crash bar for fixedly engaging the plate to the crash bar within the gap, such that the plate is positioned for preventing actuation of the crash bar such that the door cannot be opened.

7. The door and door security assembly combination of claim 6, wherein the plate is sized such that the plate extends past at least one door jamb of a doorway in which the door is positioned, wherein the plate is configured for engaging the at least one door jamb for resisting opening of the door.

8. The door and door security assembly combination of claim 6, wherein the cutout is biased toward one of opposed ends of the plate.

9. The door and door security assembly combination of claim 6, wherein the fastener comprises a dip hingedly engaged to and extending transversely from the plate proximate to the lower edge of the plate and a respective opposed side of the cutout, the clip being resilient such that the clip is positioned for hinging toward the respective opposed side of the cutout as the plate is positioned over the crash bar, such that the clip is positioned for rebounding when the crash bar is lay inserted into the cutout, such that the clip engages a lower face of the crash bar for fixedly engaging the plate to the crash bar within the gap, such that the plate is positioned for preventing actuation of the crash bar such that the door cannot be opened.

10. The door security assembly of claim 6, wherein the pin is spring loaded such that the pin is biased to an extended configuration.

11. A door security assembly comprising:

a blockade device having an element configured to be insertable into a gap defined by a door and a crash bar engaged thereto, the blockade device comprising a plate having a cutout extending into a lower edge thereof, wherein the cutout is configured for insertion of the crash bar such that the plate is inserted into the gap, the plate being sized such that the plate extends past at least one door jamb of a doorway in which the door is positioned, wherein the plate is configured for engaging the at least one door jamb fir resisting opening of the door, the cutout being biased toward one of opposed ends of the plate; and a pair of fasteners engaged to the blockade device, each fastener being configured for selectively engaging the crash bar such the blockade device is reversibly engaged to the crash bar with the element positioned in the gap, wherein the blockade device is configured for preventing actuation of the crash bar such that the door cannot be opened, the fastener comprising at least one of:

a clip hingedly engaged to and extending transversely from the plate proximate to the lower edge of the plate and a respective opposed side of the cutout, the clip being resilient wherein the clip is configured for hinging toward the respective opposed side of the cutout as the plate is positioned over the crash bar, such that the clip is positioned for rebounding when the crash bar is fully inserted into the cutout, such that the clip engages a lower face of the crash bar for fixedly engaging the plate to the crash bar within the gap, wherein the plate is configured for preventing actuation of the crash bar such that the door cannot be opened, and a slide lock, the slide lock comprising:

a pin selectively extensible into the cutout from a channel, the channel extending into the plate from the respective opposed side of the cutout, the plate having a slot positioned in a front face thereof and extending to the channel, the pin being spring loaded such that the pin is biased to an extended configuration, and a knob extending from the front face and through the slot, the knob being engaged to the pin, wherein the knob is configured for grasping in digits of a hand of a user, positioning the user for selectively sliding the knob within the slot away from the respective opposed side of the cutout for retracting the pin into the channel, such that the crash bar is positionable in the cutout, such that the pin extends from the channel into the cutout upon release of the knob, such that the pin engages the lower face of the crash bar for fixedly engaging the plate to the crash bar within the gap, wherein the plate is configured for preventing actuation of the crash bar such that the door cannot be opened.

* * * * *